United States Patent [19]

Pollard et al.

[11] 4,332,201

[45] Jun. 1, 1982

[54] STEERING RAILWAY VEHICLE TRUCKS

[75] Inventors: Maurice G. Pollard, Mickleover; Allan Sutton, Duffield, both of England

[73] Assignee: British Railways Board, London, England

[21] Appl. No.: 41,169

[22] Filed: May 21, 1979

[30] Foreign Application Priority Data

May 26, 1978 [GB] United Kingdom ..... 23576/78

[51] Int. Cl.[3] ..... B61F 3/08; B61F 5/36; B61F 5/38; B61F 5/52

[52] U.S. Cl. ..... 105/167; 105/168; 105/182 R; 105/204; 105/224.1

[58] Field of Search ..... 105/167, 168, 165, 182 R, 105/204, 224.1, 166

[56] References Cited

U.S. PATENT DOCUMENTS

| | | | |
|---|---|---|---|
| 1,498,605 | 6/1924 | Barrows | 105/204 |
| 2,296,106 | 9/1942 | Holland et al. | 105/167 |
| 3,528,374 | 9/1970 | Wickins | 105/168 X |
| 4,003,316 | 1/1977 | Monselle | 105/224.1 |
| 4,044,689 | 8/1977 | Eggert, Jr. | 105/224.1 X |
| 4,067,261 | 1/1978 | Scheffel | 105/224.1 X |
| 4,131,069 | 12/1978 | List | 105/182 R X |
| 4,134,343 | 1/1979 | Jackson | 105/167 |
| 4,244,297 | 1/1981 | Monselle | 105/182 R X |

FOREIGN PATENT DOCUMENTS

| | | | |
|---|---|---|---|
| 1179723 | 1/1970 | United Kingdom | 105/168 |

*Primary Examiner*—Joseph F. Peters, Jr.
*Assistant Examiner*—Howard Beltran
*Attorney, Agent, or Firm*—Pollock, Vande Sande & Priddy

[57] ABSTRACT

Railway vehicle trucks having at least two wheel-sets, each with a live axle mounted in a respective pair of bearings, at least one axle bearing of one wheel-set being elastically interconnected with at least one axle bearing of the other wheelset through bracing structure providing bracing between the wheel-sets. Side frames are connected to respective axle boxes via a primary spring mounting and each side frame is of fabricated construction constituting a bridge member of I-section form which a sub-frame depends, the bridge member and sub-frame defining a space therebetween into which respective side flanges of a bolster project, each said side flange being supported by the respective sub-frame via a secondary spring mountings.

8 Claims, 9 Drawing Figures

STEERING RAILWAY VEHICLE TRUCKS

BACKGROUND OF THE INVENTION

This invention relates to railway vehicles and particularly to running gear therefor, and is applicable not only to railway vehicles in which the vehicle body is supported on trucks or bogies, but also where the vehicle body is supported directly on wheel-sets, e.g. four-wheeled vehicles, and where a combination of bogies and wheel-sets may be used to support the body. The invention is also applicable to railway vehicles which are articulated together and where adjacent ends of two vehicles are carried on a single common bogie.

Existing designs of running gear for railway vehicles depend for their riding ability on the provision of stiffness and frictional or viscous restraint between the vehicle body and the wheel sets. Consequently because these parameters inhibit relative movement of the vehicle body and wheel-sets, high stability performance is obtained at the cost of an inferior performance in negotiating curves in the railway track.

In order to provide for good stabilization of a vehicle at high speed, while permitting relatively free movement of the vehicle through curves in the railway track, an arrangement has been proposed for railway vehicle running gear of the kind having side frames, a bolster and at least two wheel-sets, each wheel-set being a live axle mounted in a respective pair of axle bearings, wherein at least one axle bearing of one wheel-set is elastically interconnected with at least one axle bearing of the other wheel-set through bracing means which serve no vertical load carrying function at least intermediate their connections to the axle bearings, said bracing means providing bracing between the wheel-sets which produces high restoring forces when the wheel-sets have a parallel but misaligned disposition, and low restoring forces when the wheel-sets have an aligned but non-parallel disposition.

Such an arrangement has been described and claimed in Wickens U.S. Pat. No. 3,528,374 issued Sept. 15, 1970 for "Railway Truck Resiliently Interconnected Axle Boxes". An object of this invention is to provide an advantageous construction of such an arrangement as well as various other improvements.

SUMMARY OF THE INVENTION

According to one aspect of this invention there is provided in a railway vehicle, running gear of the kind having side frames, a bolster, and at least two wheel-sets, each wheel-set being a live axle mounted in a respective pair of axle bearings, at least one axle bearing of one wheel-set being elastically interconnected with at least one axle bearing of the other wheel-set through bracing means providing bracing between the wheel-sets, said bracing means comprising a frame structure for each wheel-set which extends transversely of the vehicle and is connected between axle boxes housing said axle bearings of its respective wheel-set, the improvement wherein each of said frame structures comprises a first frame member which is transversely arranged and extends substantially horizontally, and a pair of a second frame members rigidly connected one at each outer end of said first frame member, said second frame members extending upwardly and being rigidly connected at their upper ends to respective axle boxes of their wheel-set, said first frame members being connected at their inner ends via said elastic connection at a level well below said live axles, and said bolster being mounted on said side frames between wheel-sets and within the space defined by construction of said frame structures, said bolster being unobstructed by said frame structures with said first frame members passing freely beneath said bolster.

The bolster may be provided with side flanges which are supported via a secondary spring mounting (preferably "flexicoiling" springs) within the height of side frames for the vehicle, and the arrangement may be such that the effective working height (defined hereinafter) of the secondary spring mounting provided is substantially the same as that for the primary spring mounting provided between said side frames and respective axle boxes of the wheel-sets.

According to a feature of this invention the railway vehicle running gear may have its said side frames connected to respective axle boxes via said primary spring mountings with the plan-view stiffness of each said primary spring mounting being designed to be less than the lateral stiffness of said elastic connection.

In one form each primary spring mounting may comprise rubber pads which provide a required vertical/-plan-view stiffness ratio.

According to a further feature of this invention, in said railway vehicle running gear each said side frame is of fabricated construction comprising a bridge member and a subframe depending therefrom which define a space therebetween into which respective said side flanges of a bolster project, and a combined vertical and lateral damping arrangement for the bolster housed within each said space and comprising a pair of friction blocks which are loaded by spring biassing means into contact with friction liners extending transversely between and fixed to said sub-frames of respective side frames.

With running gear according to the invention it is desirable for good curving that the wheel treads have a high effective conicity.

BRIEF DESCRIPTION OF THE DRAWINGS

In order that the invention may be readily understood and further features made apparent, running gear in the form of a railway bogie (or truck) and two modifications thereof, constructed in accordance therewith, will now be described, by way of example, with reference to the accompanying drawings in which.

FIGS. *7a* and *7b* are enlarged, fragmentary detail views from FIGS. 1 and 3 respectively, showing two alternative arrangements for the primary spring mounting.

DESCRIPTION OF THE PREFERRED EMBODIMENTS

Figure 1:
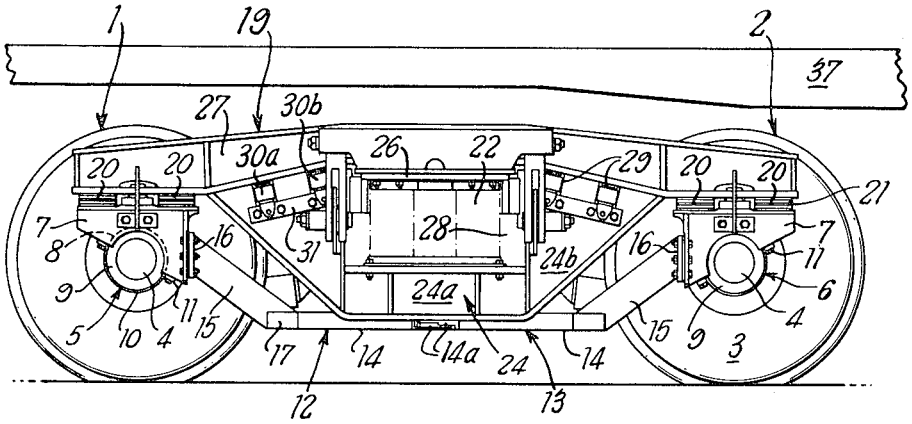
FIG. 1 is a side-view of the bogie.
Figure 3:
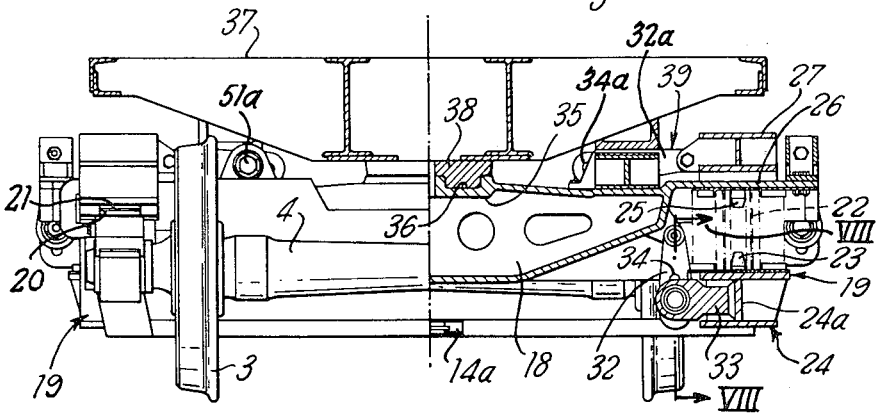
FIG. 3 is a view in half-section on the line III—III of FIG. 2.
Figure 2:
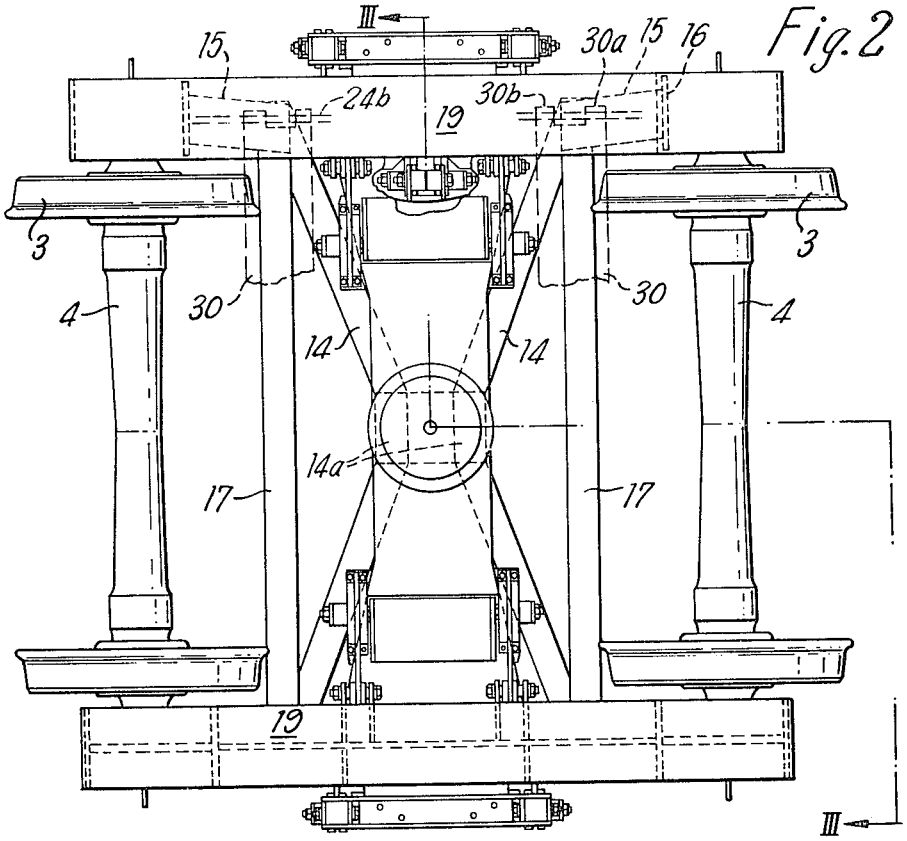
FIG. 2 is a plan view of the bogie.

Referring to FIGS. 1 to 3, the bogie comprises two wheel-sets 1, 2 each comprising wheels 3 mounted on live axles 4, (i.e. each axle is solidly connected to its wheels 3). The wheels shown in FIGS. 1 to 3 have high effective conicity, i.e. $\lambda$ in the range 0.05 to 0.5 and preferably 0.2 to 0.3. The wheel-set 1 rotates in axle bearings 5, while the wheel-set 2 rotates in axle bearings 6. The axle bearings are located in this example, but not necessarily, at the two ends of the axles of their respective wheel-sets and each bearing location comprises a box 7 which is designed to provide a bearing support surface having an included angle of not more than 180°. By providing a bearing support surface 8 which is semi-circular (or slightly less than semi-circular), a cartridge bearing 9 may be readily located on said surface and rigidly fixed in position by a part-circular strap 10 (see FIG. 1). Each strap may be tightened down onto its cartridge bearing 9 by the use of bolts 11 as shown in FIG. 1, or by a suitable detachable coupling (e.g. a hook-shaped joint) at one end of the strap and a bolt at the other end.

Figure 4:
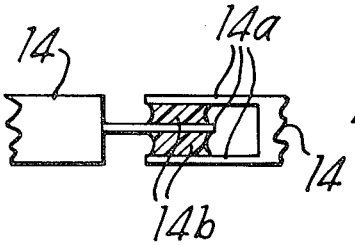
FIG. 4 is an enlarged detail of an elastic connection for the cross-bracing.

The axle boxes 7 in this arrangement form an integral part of the cross-bracing. Thus the cross-bracing comprises two rigid framework structures 12, 13 which extend between the axle-boxes 7 of each wheel-set 1, 2. In this embodiment each framework comprises a transverse frame member 14 of generally shallow V-form in plan, the ends of which are welded to upwardly inclined longitudinal frame members 15; these frame members are of suitable cross-section so that the structure is stiff both transversely and longitudinally (e.g. of box or I-section). The free ends of the members 15 of each structure are provided with flanges 16 by which they are rigidly attached to their respective axle boxes either by bolts as shown, or by welding, or any other stiff connection. Each transverse member 14 of each structure 12, 13 is provided at its apex with a connecting plate 14*a* by which the members are flexibly connected by any suitable arrangement restraining the wheel sets 1, 2 from relative linear displacements, but permitting the wheel-sets 1, 2 to move freely relative to each other with rotational displacements such as in the yaw sense (for negotiating curves), perhaps with a small restoring torque. The flexible connection must also permit limited amounts of differential roll and pitch between the structures 12 and 13 and hence their respective wheel-sets 1 and 2. For example, the connecting plates 14*a* may provide tongue and channel sections (see FIG. 4), the tongue being connected to the walls of the channel via rubber pads 14*b* bonded thereto (see FIG. 4). Alternative arrangements for such a connection include the use of a "spherilastic" bearing i.e. a universal joint with a flexible insert between the joint components, or by use of "flexural" steel. In this embodiment each structure 12, 13 includes a welded-in transversely extending strut 17 extending between respective frame members 15 in the plane of its respective V-frame member 14 or 15, as shown in FIGS. 1 and 2. The struts 17 improve the longitudinal stiffness of the cross-bracing.

It can be readily seen from FIG. 1 that the transverse frame members 14 are supported well below the height of the axles 4 of the wheel-sets, due to the inclination of frame members 15. This is to provide adequate space to accommodate a bolster 18 (see FIG. 3) between the main side frames 19 of the bogie. Each side frame 19 extends in the longitudinal direction of the bogie and is supported at its ends by the appropriate axle boxes 7 of the wheel-sets 1 and 2, each end of each frame being flexibly connected to its respective axle box via pairs of rubber pads 20 which provide the primary spring mounting and which act to restrain the axle box in pitch. It should be noted here that the lateral stiffness of each of these pads 20 is less than the lateral stiffness of the flexible connection between the cross-bracing structures 12, 13 to ensure that lateral and longitudinal movements in use tend to be accommodated by the primary spring mounting with low resultant forces, i.e. the primary plan view suspension is of low stiffness. The rubber pads 20 may be in the form of laminated units incorporating steel plates 21 (as shown in FIG. 1) in order to obtain an acceptable vertical/lateral stiffness ratio.

In FIG. 1, the rubber pad/plate units are shown horizontal but they could be arranged to be inclined at a predetermined angle to the horizontal to produce a desired longitudinal/lateral stiffness relationship for the primary spring mounting. Thus, referring to FIG. *7a*, the rubber pad/plate units may be inclined as shown if it is required to provide extra stiffness in the longitudinal direction of the bogie. If extra stiffness is required in the lateral direction of the bogie, the unit 20, 21 may be inclined as shown in FIG. *7b*. The arrangement of the axle boxes 7 and primary spring mounting is such that the rubber pads 20 of the latter are at a relatively small height above the axes of the wheel sets 1 and 2. Consequently, the effective working height, i.e., the height at which a force applied to the primary spring mounting will produce motion only in a horizontal plane (pure horizontal motion), of these pads for lateral and longitudinal movement is relatively low down on the bogie. This feature, coupled with the space provided by the relatively low position of the transverse frames 14 of the cross-bracing arrangement, facilitates the use of so-called "flexicoiling" springs (i.e. coil springs which are designed to take up shear movement in addition to vertical movement) to provide a secondary spring mounting for vertical and lateral movements, since it is desirable, although not essential that the effective work height of the flexicoiling springs is substantially the same as that for the rubber pads 20 of the primary spring mounting.

Referring to the drawings, in particular FIGS. 1 and 3, it can readily be seen that a flexicoiling spring mounting 22 is provided on each side of the bogie at a central position between the wheel-sets 1 and 2 and each spring in the mounting is located at its lower end over a spigot 23 on a sub-frame part 24 of its side frame 19. The upper end of each spring is located over a further spigot 25 projecting from the underside of a side flange 26 of the bolster 18.

Each side frame 19 in this embodiment is constructed from steel plate (rather than a conventional casting) and comprises a bridge member 27 from which the sub-frame 24 depends. It will be noted that the bridge member and sub-frame define a rectangular space 28 within which its associated flexicoiling springs 22 and flange 26 of the bolster 18 are located. The bridge member and sub-frame of each side frame are basically of I-section and, in order to ensure a satisfactory fatigue life, the dimensions of the I-sections vary according to the distribution of load to which it is subjected in use. The variation of the I-sections is shown particularly in FIG. 1. It will also be noted from this figure that the sub-frame 24 is hung from the bridge member 19 and includes an I-section part 24*a* of constant section and two triangular fillet parts 24*b*. The webs of the fillet parts 24*b* are provided with aligned pairs of spaced rectangular recesses 29 which are adapted to support the ends of two brake beams 30; for this purpose each end of each brake beam is bifurcated to provide two spigot portions 30*a* and 30*b* which locate into and through their respective recesses 29 to rest on a reinforcing plate 31 attached to a respective said web and extending between the pair of recesses. This fixing arrangement has the advantage that, compared with the conventional signal spigot fixing arrangement, it provides improved torsional restraint to the brake beams and also a more satisfactory distribution of load to the side frames 19. For clarity only a part of each brake beam 30 is shown by dash lines in FIG. 2.

Figure 8:
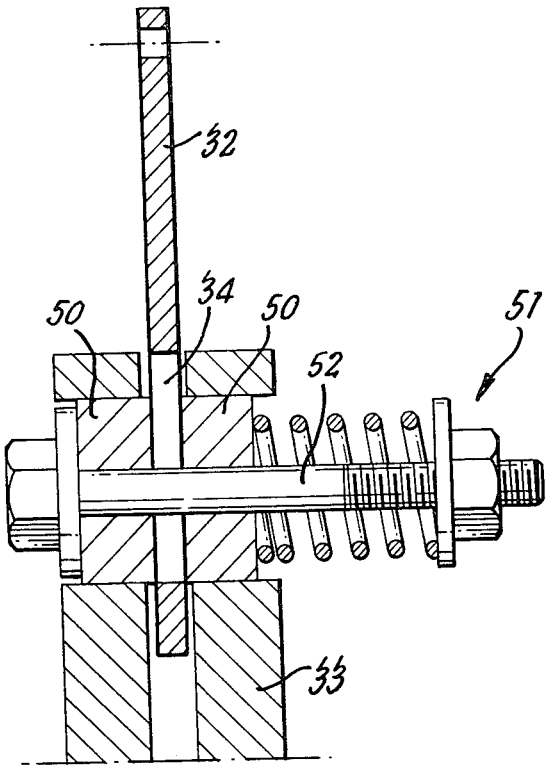
FIG. 8 is an enlarged section taken on line VIII—VIII of FIG. 3 through a vertical damper for the bogie.

The design of the side frames enables the bolster 18 if desired to be fabricated using standard sections and plate (instead of the conventional cast construction), since no complicated profiles or cut-outs need to be formed in the bolster. The cross-section of the bolster included in FIG. 3 is of conventional cast construction and, referring also to FIG. 8, has a vertical damper arrangement comprising a link 32 pivoted to each side of the bolster and frictionally engaged by friction pads 50 which are supported within aligned apertures in and held in frictional engagement against opposed faces of said link by a suitable spring-biasing means 51. The means 51 includes a bolt 52 which passes through a vertically extending part 33 carried by the sub-frame 24, a slot 34 provided in the links 32 to limit the vertical extent of the damping movement. A similar arrangement 39, which includes a link 32*a*, having a horizontally extending slot 34*a*, against which link friction pads (not shown) are urged by spring-biasing means 51*a*, provides for lateral damping between the bolster and the bridge members 27 of the side-frames. As shown in FIG. 3, the central part 35 of the upper face of the bolster is strengthened and provided with a cast annular recess 36 for rotatably supporting the underframe 37 of the vehicle body via a mating annular ring 38.

Figure 5:
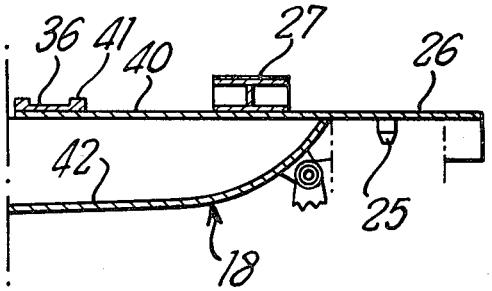
FIG. 5 is a half-section similar to FIG. 3 showing a modified form of bolster.

Referring to FIG. 5, a bolster 18 of fabricated construction is shown as an alternative to the cast bolster of FIG. 3. It will be noted that the construction includes an upper steel plate 40, onto the upper surface of which an annular ring 41 is located centrally and welded thereto to provide the annular recess 36. The steel plate is strengthened and made stiff by a dished lower plate 42 which is welded to the underside of the plate 40 which, in this embodiment, but not necessarily, leaves a projecting outer edge of the plate 40 which constitutes the side flange 46.

Figure 6:
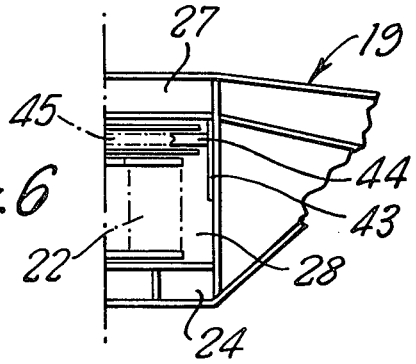
FIG. 6 is a fragmentary half-view similar to FIG. 1 of a modified vertical damper arrangement.
Figure 7A:
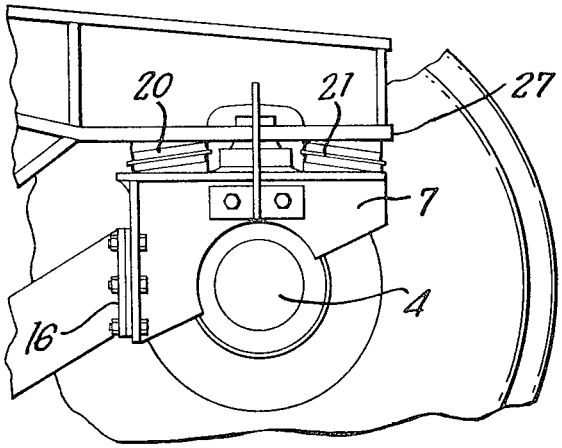
Figure 7B:
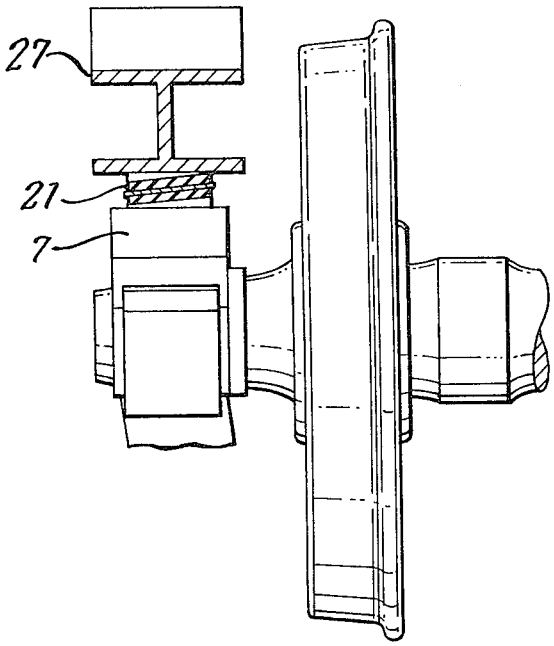

With the design of the side frames 19 as described above and because of the rectangular spaces 28 defined therein an alternative form of vertical damper arrangement to that described above with reference to FIG. 3 has been proposed. Thus, referring to FIG. 6, the damper arrangement comprises two vertical friction liners 43 extending transversely between and rigidly fixed to the sub-frame 24 of the two side frames 19, each liner being arranged to receive in frictional engagement therewith a friction block 44. The friction blocks 44 are urged into engagement with their respective liners by spring biassing means, 45, which may provide a predetermined loading to control the frictional effect, and hence the damping rate, of the arrangement. It will be seen from FIG. 6 that the alternative damper arrangement can be made as an extremely compact unit and located in that part of the space 28 above the flexicoiling spring mounting 22.

What we claim is:

1. In a railway vehicle, a truck having side frames, a bolster, and at least two wheel-sets, each wheel-set being a live axle mounted in a respective pair of axle bearings, at least one axle bearing of one wheel-set being elastically interconnected with at least one axle bearing of the other wheel-set through bracing means providing bracing between the wheel-sets, said bracing means comprising a frame structure for each wheel-set which extends transversely of the vehicle and is connected between axle boxes housing said axle bearings of each respective wheel-set, the improvement wherein each said frame structure comprises a first frame member which is transversely arranged and extends substantially horizontally, and a pair of second frame members rigidly connected one at each outer end of said first frame member, said second frame members extending upwardly and being rigidly connected at their upper ends to respective axle boxes of their wheel-set, said first frame members being connected intermediately via an elastic connection at a level well below said live axles, on said side frames between the wheel-sets and within and above the space defined by construction of said frame structures, said first frame members passing freely beneath said bolster.

2. A railway vehicle truck according to claim 1 wherein said bolster is provided with side flanges, a secondary spring mounting provided within the height of said side frames for said bolster, and a primary spring mounting provided between said side frames and said axle boxes for supporting said side frames and for restraining said axle boxes in pitch, said primary and secondary spring mountings being located relatively to each other so that the effective working height of the two spring mountings is substantially the same.

3. A railway vehicle truck according to claim 2 wherein each side frame comprises a bridge member and a sub-frame depending therefrom which define a space into which respective said side flanges of said bolster project, and a combined vertical and lateral damping arrangement for the bolster housed within each said space, each said damping arrangement comprising a pair of friction blocks which are loaded by spring biassing means into contact with friction liners extending transversely between and fixed to said sub-frames of respective side frames.

4. A railway vehicle truck according to claim 2 wherein said secondary spring mounting is in the form of flexicoiling springs.

5. A railway vehicle truck according to claim 2 wherein the plan-view stiffness of each said primary spring mounting is less than the lateral stiffness of said elastic connection.

6. A railway vehicle truck according to claim 5 wherein each primary spring mounting comprises rubber pads which are dimensioned to provide a predetermined vertical/plan-view stiffness ratio.

7. A railway vehicle truck according to claim 6 wherein said rubber pads are in the form of laminated units incorporating steel plates.

8. A railway vehicle truck according to claim 6 or claim 7 wherein said rubber pads are inclined at an angle to the horizontal to produce a predetermined longitudinal/lateral stiffness relationship for said primary spring mounting.

* * * * *

UNITED STATES PATENT AND TRADEMARK OFFICE

CERTIFICATE OF CORRECTION

PATENT NO. : 4,332,201

DATED : June 1, 1982

INVENTOR(S) : Maurice G. Pollard and Allan Sutton

It is certified that error appears in the above-identified patent and that said Letters Patent are hereby corrected as shown below:

Column 6 line 24 following "axles," insert -- and said bolster being mounted --

Signed and Sealed this

*Eleventh* Day of *January 1983*

[SEAL]

*Attest:*

GERALD J. MOSSINGHOFF

*Attesting Officer*

*Commissioner of Patents and Trademarks*